United States Patent [19]

Ozawa et al.

[11] Patent Number: 4,716,592

[45] Date of Patent: Dec. 29, 1987

[54] METHOD AND APPARATUS FOR ENCODING VOICE SIGNALS

[75] Inventors: Kazunori Ozawa; Takashi Araseki, both of Tokyo, Japan

[73] Assignee: NEC Corporation, Tokyo, Japan

[21] Appl. No.: 565,804

[22] Filed: Dec. 27, 1983

[30] Foreign Application Priority Data

Dec. 24, 1982 [JP] Japan ..... 57-231603
Dec. 24, 1982 [JP] Japan ..... 57-231605
Dec. 24, 1982 [JP] Japan ..... 57-231606

[51] Int. Cl.[4] ..... G10L 5/00
[52] U.S. Cl. ..... 381/40
[58] Field of Search ..... 381/29–50

[56] References Cited

U.S. PATENT DOCUMENTS 4,544,919 10/1985 Gerson ..... 381/41

OTHER PUBLICATIONS

Makhoul, J., "Stable and Efficient Lattice Methods for Linear Prediction", IEEE ASSP-25, No. 5, Oct., 1977, pp. 423–428.

"A New Model of LPC Excitation for Producing Natural-Sounding Speech at Low Bit Rates" on pp. 614 to 617 of Advanced Manuscripts Published by I.C-.A.S.S.P., 1982.

J. Max's paper of the title "Quantizing for Minimum Distortion", IRE Transactions on Information Theory, 1960, Mar., pp. 7 to 12.

J. Makhoul's paper entitled "Linear Prediction: A tutorial Review", pp. 561 to 580, Apr., 1975 of Proceedings of IEEE.

R. Viswanathan et al paper of the title "Quantizing Properties of Transmission Parameters in Linear Predictive Systems", pp. 309 to 321, IEEE Transactions on Acoustics, Speech, and Signal Processing, Jun., 1975.

*Primary Examiner*—Thomas M. Heckler
*Attorney, Agent, or Firm*—Sughrue, Mion, Zinn, Macpeak & Seas

[57] ABSTRACT

A voice encoding system is constituted by a short time voice signal series producing circuit inputted with a discrete voice signal series for dividing the same at each short time; a parameter extracting circuit for extracting a parameter representative of a spectrum envelope from the short time voice signal series and encoding the parameter; an impulse response series calculating circuit for calculating the impulse response series based on the parameter representative of the spectrum envelope; an autocorrelation function sequence calculating circuit utilizing the impulse response series; a cross-correlation function sequence calculating circuit utilizing the impulse response series and the short time voice signal series; a circuit for calculating and encoding an excitation signal series of the short time voice signal series by utilizing the autocorrelation function sequence; and a circuit for combining and outputting a code of the parameter representative of the spectrum envelope and a code representative of the excitation signal series. With the system, high quality voice encoding can be made at a transmission rate of less than 10k bits/second with a relatively small amount of calculation.

5 Claims, 23 Drawing Figures

METHOD AND APPARATUS FOR ENCODING VOICE SIGNALS

BACKGROUND OF THE INVENTION

This invention relates to a low bit rate encoding system of a voice signal, and more particularly an encoding system in which the rate of the transmitted signal is made to be less than 10k bits/second.

As an effective method of encoding a voice signal at a transmission information rate of less than 10k bits/-second, a method has been known in which an excitation signal of a voice signal is searched at each short interval while maintaining the error between a synthesized signal and an input signal at a minimum. Depending upon the type of the method of search, this method is called a tree coding method or a vector quantization method. In addition to these methods, a system has recently been proposed according to which a plurality of pulse series or trains representing the excitation signal series are sequentially obtained at each short interval by using an analysis-by-synthesis (A-b-S) method on the side of an encoder. The invention uses this A-b-S method and the detail thereof is described in B. S. Atal et al paper entitled "A New Model of LPC Excitation For Producing Natural-sounding Speach at Low Bit Rates" on pages 614 to 617 of advanced manuscripts published by I.C.A.S.S.P., 1982, (hereinafter called paper No. 1). The outline of this paper will be described later.

This prior art system however has a defect that the quantity to be calculated is extremely large. Because according to this system, at the time of calculating the position and amplitude of the pulse in the excitation pulse series, it is necessary to calculate the error and the error power between a signal synthesized from the pulse and an original signal to feedback the error and error power thereof for adjusting the position and amplitude of the pulse and in addition, it is necessary to repeat a series of processings until the number of pulses reaches a predetermined number.

Furthermore, according to this prior art system, since the analysis frame length is constant, degradation is caused by the discontinuity of the waveform near the boundary of the frames of the reproduced signal series when the frame is switched at a portion where the power of the input voice signal series is large, thus greatly imparing the quality of the reproduced voice.

SUMMARY OF THE INVENTION

Accordingly, it is an object of this invention to provide a high quality voice encoding system that can be applied to a transmission rate of less than 10k bits/-second with a relatively small number of calculations.

Another object of this invention is to provide an improved voice encoding system wherein degradation of the voice quality near the frame boundary is negligible.

Still another object of this invention is to provide a novel voice encoding system capable of greatly decreasing the number of calculations and also providing advantages just mentioned.

According to this invention, there is provided a voice encoding system comprising means inputted with a discrete voice signal series for dividing the voice signal series at each short time to obtain a short time voice signal series; means for extracting a parameter representative of a spectrum envelope from the short time voice signal series and encoding the parameter; means for calculating an impulse response series based on the parameter representative of the spectrum envelope; means for calculating an autocorrelation function sequence by using the impulse response series; means for calculating a cross-correlation function sequence by using the impulse response series and the short time voice signal series; means for calculating and encoding an excitation signal series of the short time voice signal series by using the autocorrelation function sequence and the cross-correction function sequence; and means for combining and outputting a code of the parameter representative of the spectrum envelope and a code representative of excitation signal series.

According to this invention, there is provided a method of encoding a voice comprising the steps of inputting a discrete voice signal series on a transmission side; subtracting a response signal series originating from a previously determined excitation signal series from the voice signal series; extracting and encoding a parameter representative of the voice signal series or short time spectrum envelope of the result of the subtraction; determining an impulse response series based on the parameter representative of the spectrum envelope and calculating an autocorrelation function sequence of the impulse response series; forming a target signal series based on the result of the subtraction and calculating a cross-correction function sequence between the target signal series and the impulse response series; searching and encoding a excitation signal series of the voice signal series by using the autocorrelation function sequence and the cross-correlation function sequence; forming a response signal series originating from the excitation signal series; combining and outputting a code series of a parameter representative of the spectrum envelope and a code series of the excitation signal series; inputting the code series on a receiving side and separating the code series of the excitation signal series and the code series of the parameter representative of the spectrum envelope; decoding the excitation signal series from the separated code series for producing an excitation pulse series; synthesizing the voice signal series by using a parameter representative of a spectrum envelope decoded from the separated code series of the inputted excitation pulse series; and calculating a response signal series originating from the excitation pulse series and adding together the response signal series and the synthesized voice signal series to output the result of the addition.

According to another aspect of this invention, there is provided an encoding system comprising a subtracting circuit inputted with a discrete voice signal series and subtracting a response signal series from the voice signal series; a parameter calculating circuit extracting and encoding a parameter representaive of the voice signal series or a short time spectrum envelope of the output series of the subtracting circuit; an impulse response series calculating circuit calculating an impulse response series based on the parameter representative of the spectrum envelope; an autocorrelation function sequence calculating circuit inputted with the output series of the impulse response series calculating circuit for calculating an autocorrelation function sequence; a cross-correlation function calculating circuit for calculating a cross-correlation function sequence between the output series of the subtracting circuit or a signal obtained by subjecting the output series of the subtracting circuit to a predetermined correction and the impulse response series; an excitation signal series calculating circuit inputted with the autocorrelation funtion sequence and the cross-correlation function sequence for calculating and encoding the excitation signal of the voice signal series; a response signal series calculating circuit inputted with the excitation signal series for calculating the response signal series originating from the excitation signal series, and a multiplexer circuit for combining and outputting the output code series of the parameter calculating circuit and the code series of the excitation signal series.

According to another aspect of this invention, there is provided a decoding apparatus comprising a subtractor subtracting a response signal series originating from an excitation signal series obtained previously from a discrete voice signal series; a first encoder extracting and encoding a parameter representative of the voice signal series or a short time spectrum envelope of the result of subtraction; a second encoder searching and encoding an excitation signal series by using a cross-correlation function sequence calculated based on an impulse response series obtained from the parameter and the result of subtraction and using an autocorrelation function sequence calculated based on the impulse response series; a demultiplexer circuit inputted with a code series formed by combining an output code series of a parameter calculating circuit and a code series of the excitation signal series for separating a code series representative of the excitation signal series and a code series of a parameter representative of the spectrum envelope; an excitation pulse series generating circuit for decoding the separated code series representative of the excitation signal series for generating an excitation pulse series; a decoding circuit for decoding the separated code series of the parameter representative of the spectrum envelope; and a synthesizing filter circuit inputted with the output series of the excitation pulse series generating circuit for synthesizing and outputting a voice signal series by using the output parameter of the decoding circuit.

According to yet another aspect of this invention, there is provided a voice encoding system comprising means inputted with a discrete voice signal series for sectionalizing the same while shifting it by a predetermined sample number; means for subtracting from the sectionalized voice signal series a response signal series originating from an excitation signal series calculated beforehand; means for extracting and encoding a parameter representative of a short time spectrum envelope by using the sectionalized voice signal series or an output series of the subtracting means; means for calculating an impulse response series based on the parameter representative of the short time spectrum envelope; means for calculating an autocorrelation function sequence by using the impulse response series; means inputted with the output series of the subtracting means and the impulse response series for calculating a cross-correlation function sequence between the output series of the subtracting means or a signal obtained by subjecting the output series of the subtracting means to a predetermined correction and the impulse response series; means for determining and encoding an excitation signal series for a voice signal series of a smaller sample number than the sectionalized voice signal series by using the autocorrelation function sequence and the cross-correlation function sequence; and means for combining and outputting a code of a parameter representative of the short time spectrum envelope and a code representative of the excitation signal series.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
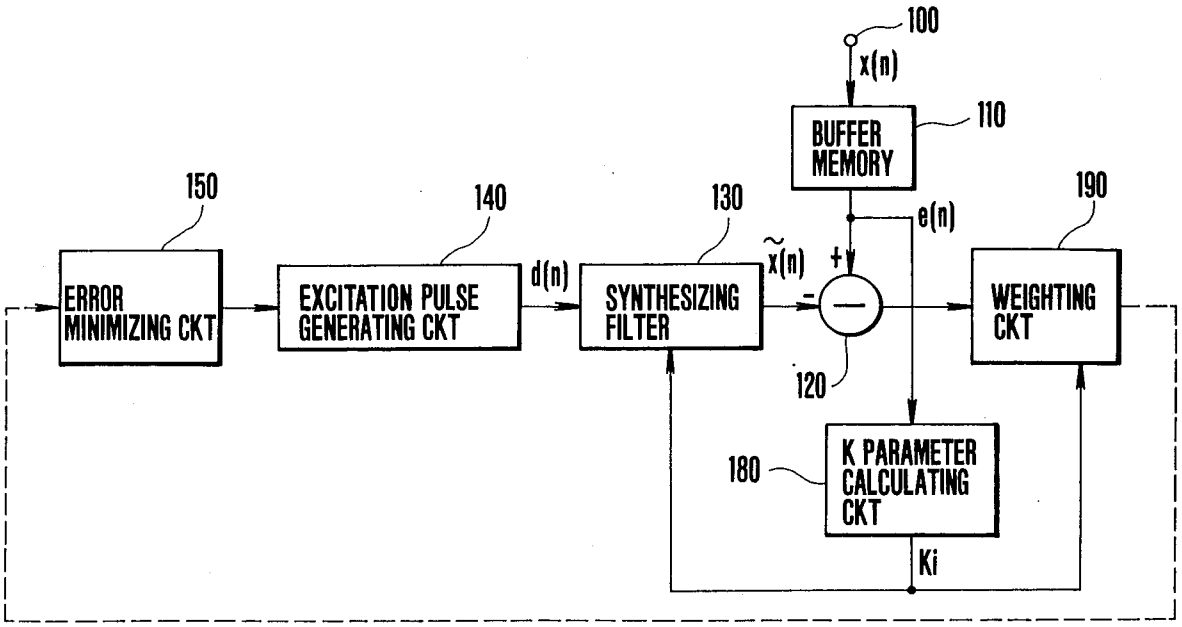
FIG. 1 PRIOR ART
FIG. 1 is a block diagram showing a prior art voice encoding system.

To have better understanding of the invention, the prior art encoder system described in paper No. 1 mentioned above will first be described with reference to FIG. 1, in which the input terminal of the encoder is designated by a reference numeral 100 to which is inputted an A/D converted voice signal series x(n). A buffer memory circuit 110 is adapted to store one frame (which includes 80 samples, when sampling is made in 10 m sec. and at 8 $KH_z$). The output of the buffer memory circuit is supplied to a subtractor 120 and a K parameter calculating circuit 180. In the paper No. 1, the K parameter is described as reflection coefficients, which are the same parameters as the K parameters. The K parameter calculating circuit 180 determines up to 16th order of the K parameter $K_i$ ($1 \leqq i \leqq 16$) representative of a voice signal spectrum for each frame according to covariance method and sends these K parameters to a synthesizing filter 130. An excitation pulse generating circuit 140 produces a pulse series of a number of pulses predetermined for one frame. In this specification, the pulse series is designated by d(n). One example of the excitation pulse generated by the excitation pulse generating circuit 140 is shown in FIG. 2 in which abscissa represents discrete time and ordinate the amplitude. In the case illustrated, 8 pulses are generated in one frame. The pulse series d(n) generated by the excitation pulse generating circuit 140 is used to excite the synthesizing filter 130 which in response to the pulse series d(n) determines a synthesized signal $\tilde{x}(n)$ corresponding to a voice signal x(n) and the synthesized signal is supplied to the subtractor 120. The synthesizing filter 130 converts the inputted K parameter $K_i$ into a prediction parameter $a_i$ ($1 \leqq i \leqq 16$) and calculates the synthesized signal $\tilde{x}(n)$ by using the prediction parameter $a_i$. The synthesized signal $\tilde{x}(n)$ can be obtained as shown in the following equation (1) by using d(n) and ai $$\tilde{x}(n) = d(n) + \sum_{i=1}^{p} a_i \tilde{x}(n-i) \tag{1}$$

where p represents the number of orders of the synthesizing filter 130. In this example p is 16. The subtractor 120 calculates the difference e(n) between the original signal x(n) and the synthesized signal $\tilde{x}(n)$ and the difference e(n) is supplied to a weighting circuit 190. This circuit 190 calculates a weighting error eω(n) according to the following equation (2) using a weighting function ω(n)

$$e_\omega(n) = \omega(n) * e(n) \tag{2}$$

in which symbol * represents convolution integral. The weighting function ω(n) applies weights along a frequency axis. By denoting its Z conversion value by W(z), W(z) can be calculated in accordance with the following equation (3) by using the prediction parameter ai of the synthesizing filter 130.

$$W(z) = \left(1 = \sum_{i=1}^{p} a_i Z^{-i}\right) / \left(1 - \sum_{i=1}^{p} a_i r^i - Z^{-i}\right) \tag{3}$$

where r is a constrant expressed by a relation $0 \leqq r \leqq 1$ and determines the frequency characteristic of W(z). In other words, where r=1, W(z)=1 and its frequency characteristic becomes flat. On the other hand, where r=0, W(z) becomes an inversion of the frequency characteristic of the synthesizing filter. Thus, the characteristic of W(z) can be varied depending upon the value of r. The reason why W(z) is determined depending upon the frequency characteristic of the synthesizing filter as shown by equation (3) lies in that an audible masking effect is to be made use of. More particularly, at a portion where the power of the spectrum of the input voice signal is large (for example near formant), even when the difference or error from the spectrum of the synthesized signal is appreciably large, such error does not affect the hearing sense of ears.

Figure 3:
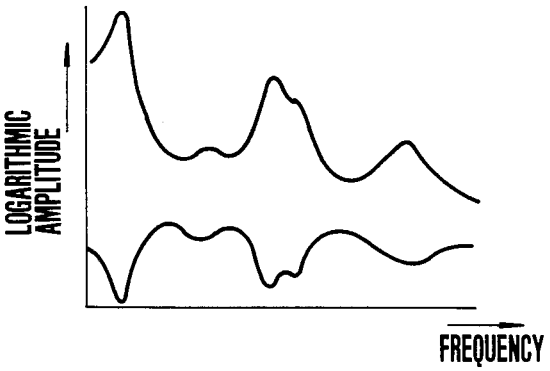
FIG. 3 shows one example of the frequency characteristic of an input voice signal series and the frequency characteristic of a weighting circuit shown in FIG. 1.

FIG. 3 shows one example of the spectrum of the input voice signal in a given frame and the frequency characterisic of W(z) in which r=0.8. In FIG. 3, the abscissa represents frequency (maximum 4 kHz) and the ordinate the logarithmic amplitude (maximum 60 dB). The upper curve shows the spectrum of a voice signal, and the lower curve the frequency characteristic of the weighting function.

Returning back to FIG. 1, the weighting error $e_\omega(n)$ is fed back to an error minimizing circuit 150 which stores the values of $e_\omega(n)$ for one frame and calculates a weighting error power according to the following equation and by using the valves $e_\omega(n)$ $$\epsilon = \sum_{n=1}^{N} e_\omega(n)^2 \tag{4}$$

where N represents the number of samples for calculating the error power. In the paper No. 1 referred to hereinabove, this period amounts to 5 m sec. which corresponds to N=40 where the sampling fequency is 8 KHz. The error minimizing circuit 150 applies the pulse position and the amplitude information to the excitation pulse generating circuit 140 so as to minimize the error power ε calculated with equation (4). Based on this information, the excitation pulse generating circuit 140 produces the excitation pulse series. By utilizing this excitation pulse series, the synthesizing filter 130 calculates the synthesized signal $\tilde{x}$ (n). The subtractor 120 subtracts presently determined synthesized signal $\tilde{x}$ (n) from the error e(n) between the previously calculated original signal and the synthesized signal so as to produce the difference as a new error e(n). The weighting circuit 190 inputted with the new error e(n) calculates a weighting error $e_\omega(n)$ and feeds back this weighted error to the error minimizing circuit 150. This circuit calculates again the error power ε and adjusts the amplitude and position of the excitation pulse series so as to minimize the error power ε. In this manner, a series of processings between the generation of the excitation pulse series and the adjustment thereof effected by minimizing the error are repeated until the number of pulses of the excitation pulse series reaches a predetermined number.

In the prior art system described above, the information to be transmitted includes the K parameter $K_i$ ($1 \leqq i \leqq 16$) of the synthesizing filter and the pulse position and amplitude of the excitation pulse series so that any transmission rate can be realized by suitably selecting the number of pulses in one frame. In a range in which the transmission rate is less than 10K bits/sec., the quality of the synthesized voice is excellent.

However, this prior art system is defective in that it requires extremely large quantity of calculations. This is caused by the fact that at the time of calculating the position and amplitude of a pulse in the excitation pulse series, the error and the error power between the synthesized signal on the basis of the pulse and the original signal are calculated and these errors are fed back to adjust the amplitude and position of the pulse. Furthermore, this is caused by the fact that a series of processings are repeated until the number of pulses reaches a predetermined value.

The voice encoding system of this invention is characterized by the algorithm for calculating the excitation pulse series. Accordingly, in the following description, this algorithm will be described in detail.

The excitation pulse series d(n) at any time n in one frame is expressed as follows.

$$d(n)=\Sigma g_k \delta n,\ m_k \tag{5}$$

in which δn, mk represents the Kronecker's delta which is 1 when $n=m_k$ but 0 when $n\neq m_k$ and $g_k$ represents the pulse amplitude at a position $m_k$. The synthesized signal $\tilde{x}(n)$ obtained by inputting d(n) into the synthesizing filter 130 is given by the following equation (6) when the prediction parameter of the synthesizing filter is denoted by $a_i$ ($1\leqq i\leqq N_p$, where $N_p$ represents the order number of the synthesizing filter).

$$\tilde{x}(n) = d(n) + \sum_{i=1}^{Np} a_i \tilde{x}(n-i) \tag{6}$$

The weighting error power J for the input voice signal $\tilde{x}(n)$ and the synthesized signal $\tilde{x}$ (n) in one frame is expressed by $$J = \sum_{n=1}^{N} [\{x(n) - \tilde{x}(n)\}*\omega(n)]^2 \tag{7}$$

where ω(n) represents the impulse response of weighting function of the weighting circuit and may have the same characteristic as the prior art circuit and N represents the number of samples in one frame. Equation (7) can be modified as follows.

$$J = \sum_{n=1}^{N} [x(n)*\omega(n) - \tilde{x}(n)*\omega(n)]^2 \tag{8}$$

The term x(n)* ω(n) can be modified according to the following equation. Thus by putting $$\tilde{x}\omega(n)=\tilde{x}(n)*\ \omega(n) \tag{9}$$

and by effecting Z conversion on both sides of equation (9), we obtain, $$\tilde{X}\omega(z)=\tilde{X}(z)\ W(z) \tag{10}$$

Furthermore, $\tilde{X}(z)$ can be expressed as follows:

$$\tilde{X}(z)=H(z)\ D(z) \tag{11}$$

where D(z) represents Z conversion of the excitation pulse series equation (5), and H(z) the Z conversion value of the impulse response of the synthesizing filter 130. By substituting equation (11) into equation (10), we obtain $$\tilde{X}\omega(z)=DS(z)\ H(z)\ W(z) \tag{12}$$

By putting $H\omega(z)=H(z)\ W(z)$ and by denoting inverse Z conversion value of $H\omega(z)$ by hω(n) obtained by inverse Z conversion of equation (12), we obtain the following equation.

$$\tilde{x}\omega(n)=d(n)*\ h\omega(n) \tag{13}$$

where hω(n) represents the impulse response of a cascade connected filter comprising the synthesizing filter 130 and the weighting circuit 190. By substituting equation (5) into equation (13), we obtain the following equation $$\tilde{x}\omega(n) = \sum_{i=1}^{k} g_i h\omega(n-m_i) \tag{14}$$

where K represents the number of pulses contained in one frame.

By substituting equations (14) and (9) into equation (8), we obtain $$J = \sum_{n=1}^{N} [x\omega(n) - \sum_{i=1}^{k} g_i h\omega(n-m_i)]^2 \tag{15}$$

Thus equation (7) can be reduced to equation (15). The equation for calculating the amplitude $g_k$ and the position $m_k$ of the excitation pulse series that minimizes equation (15) can be derived out as follows.

The following equation can be derived out by partially differentiating equation (15) with $g_k$ and then putting it to 0.

$$g_k(m_k) = \frac{\phi xh(-m_k) - g_1\phi hh(m,m_k) - \ldots - g_{k-1}\phi hh(m_1,m_{k-1})}{\phi hh(m_k,m_k)} \tag{16}$$

where φxh(·) represents a cross-correlation function sequence calculated from xω(n) and hω(n), and φhh(·) represents an autocorrelation function sequence, the two of sequence being expressed by the following equations (17) and (18). In the art of voice signal processing, φhh(·) is often called a covariance function.

$$\phi xh(-m_k) = \sum_{n=1}^{N} x\omega(n)h\omega(n-m_k) = \phi hx(m_k) \tag{17}$$

$$(1 \leqq m_k \leqq N)$$

$$\phi hh(m_i, m_k) = \sum_{n=1}^{N-(m_i-m_k)} h\omega(n-m_i)h\omega(n-m_k) \tag{18}$$

$$(1 \leqq m_i,\ m_k \leqq N)$$

With equation (18), an amplitude $g_k$ corresponding to a position $m_k$ can be calculated by utilizing the pulse position $m_k$ as a parameter. More particularly, the pulse position $m_k$ is determined by selecting $m_k$ that maximizes $|g_k|$ for each pulse. This can be proven by solving equation (16) with reference to gi.

More particularly, equation (16) can be modified as follows by substituting $g_i$ in equation (15)

$$J = R_{xx}(0) - \sum_{i=1}^{k} g_i \phi_{xh}(m_i) \tag{19}$$

where J represents weighted error power when the excitation pulse $g_i$ is at a postion $m_i$, and $R_{xx}(0)$ represents power corresponding to N samples of χω(n). Since equation (19) shows that $R_{xx}(0)$ is constant in one frame, a pulse is selected for a position $m_i$ that maximizes $|g_i|$ in order to minimize J.

Figure 4:
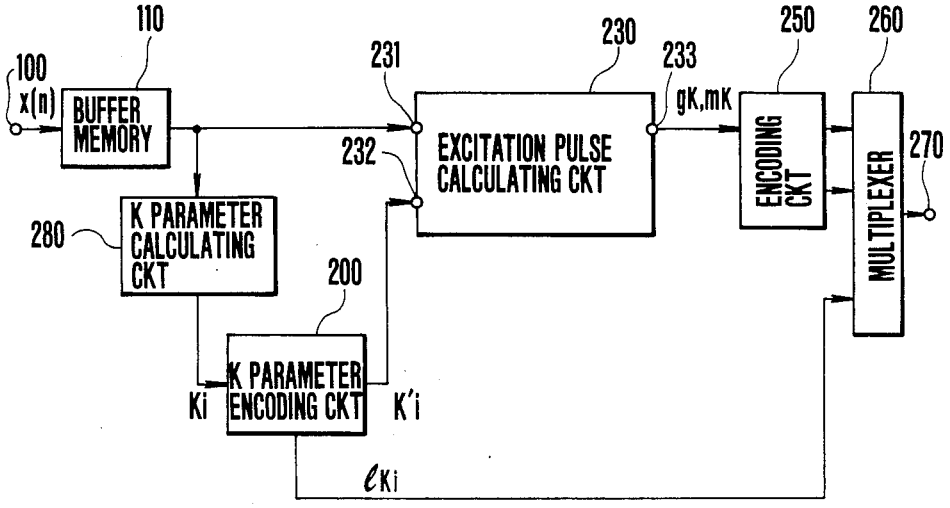
FIG. 4 is a block diagram showing one embodiment of the voice encoding system according to this invention.

FIG. 4 is a block diagram showing one embodiment of this invention utilizing the excitation pulse calculating algorithm according to equation (16). In FIG. 4, elements corresponding to those shown in FIG. 1 are designated by the same reference characters and will not be described here. FIG. 4 shows only the elements on the side of the encoder. Since the decoder may have the same construction as the prior art decoder, it is not shown herein. In FIG. 4 respective component elements execute the following processings for each frame.

A K parameter calculating circuit 280 is inputted with a voice signal x(n) stored in the buffer memory circuit 110 for calculating a predetermined number $N_p$ of K parameters $K_i (1 \leqq i \leqq N_p)$. A calculating method of extracting the K parameter value $K_i$ from the input voice signal series in the parameter calculating circuit 280 is described, for example, in J. Makhoul's paper (hereinafter called paper No. 3) entitled "Linear Prediction: A Tutorial Review", pages 561 to 580, April 1975 of Proceedings of IEEE.

The value of K parameter $K_i$ is inputted to the K parameter encoding circuit 200 which encodes $K_i$ in accordance with a predetermined quantizing bit number, and the code $l_{ki}$ thus obtained is supplied to a multiplexer. The method of encoding the K parameter in the K parameter encoding circuit 200 is described in detail in R. Viswanathan et al paper (hereinafter called paper No. (4) of the title "Quantization Properties of Transmission Parameters in Linear Predictive Systems", pages 309 to 321, IEEE TRANSACTIONS ON ACOUSTICS, SPEECH, AND SIGNAL PROCESSING, JUNE 1975. The K parameter encoding circuit 200 decodes the code $l_{ki}$ to send a decoded value $k_i'$ $(1 \leqq i \leqq N_p)$ to an excitation pulse calculating circuit 230. This excitation calculating circuit 230 is inputted with an input voice signal x(n) stored in the buffer memory circuit 110 and the K parameter decoded value and calculates the amplitude $g_k$ and the position $m_k$ of the excitation pulse series in one frame according to equations (17), (18) and (16) described above. The calculated position and amplitude are supplied to an encoding circuit 250.

Figure 5:
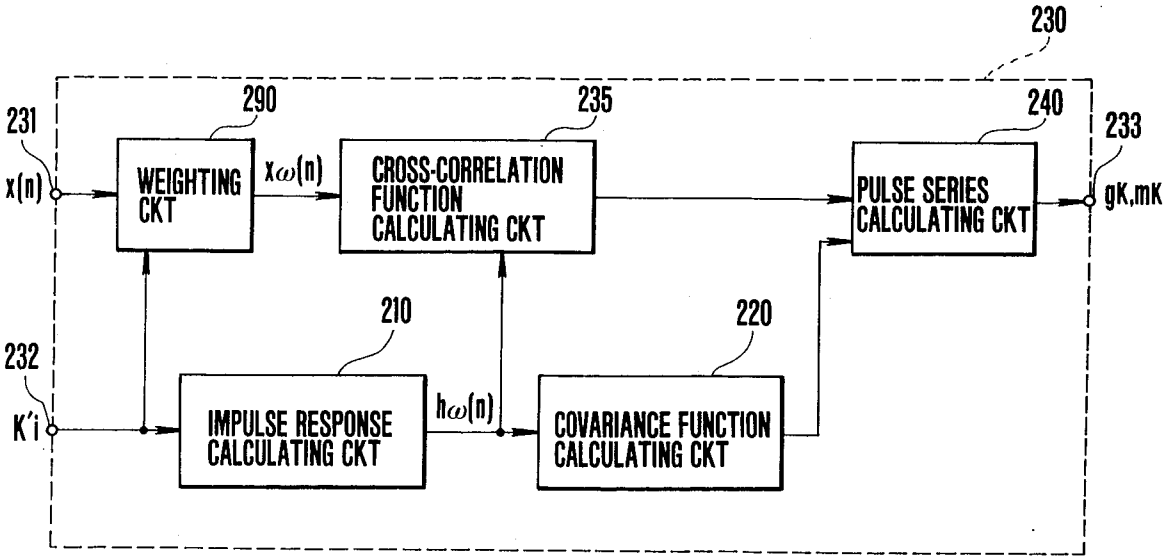
FIG. 5 is a block diagram showing one example of an excitation pulse calculating circuit 230 shown in FIG. 4.

The construction of the excitation pulse calculating circuit 230 will now be described. FIG. 5 is a block diagram showing one example of the construction of the excitation calculating circuit 230. The K parameter decoded value $K_i'$ is inputted to an impulse response calculating circuit 210 and a weighting circuit 290 through an input terminal 232. In response to the K parameter decoded value $K_i'$, the impulse response calculating circuit 210 calculates $h\omega(n)$ (the impulse response of a filter comprising the synthesizing filter and the weighting circuit in cascade connection) of equation (13) for a predetermined sample number to send the $h\omega(n)$ thus calculated to a covariance function calculating circuit 220 and a cross-correlation function calculating circuit 235. The covariance function calculating circuit 220 is supplied with $h\omega(n)$ for a predetermined number of samples to calculate the covariance function $\phi_{hh}(m_i, m_k)$, where $1 \leqq i$ and $k \leqq N$, of $h\omega(n)$ according to equation (18) and the calculated covariance function is applied to a pulse series calculating circuit 240. The weighting circuit 290 is supplied with $K_i'$ through the input terminal 232 for calculating a weighting function $\omega(n)$ according to equation (3), for example. However this function $\omega(n)$ may be calculated with other frequency weighting method. The weighting circuit 290 is also inputted with x(n) through its input terminal 231 to effect a convolution calculation of x(n) and $\omega(n)$ so as to apply the calculated $x\omega(n)$ to the cross-correlation function calculating circuit 235. The cross-correlation function calculating circuit 235 is inputted with $x\omega n)$ and $h\omega(n)$ to calculate a cross-correlation function $\phi xh(-m_k)$ where $1 \leqq m_k \leqq N$, and supplies the cross-correlation function to the pulse series calculating circuit 240. The pulse series caculating circuit 240 is supplied with $\phi_{xh}(-m_k)$ from the cross-correlation function calculating circuit 235 and $\phi hh(m_i, m_k)$, where $1 \leqq m_i$ and $m_k \leqq N$, from the covariance function calculating circuit 220 to calculate the amplitude $g_k$ of the pulse according to equation (16). For example, the amplitude $g_1$ of the first pulse is calculated as a function of the position $m_1$ by putting $k=1$ in equation (16). Then the $m_1$ that maximizes $|g_1|$ is selected and $m_1$ and $g_1$ thus obtained are determined as the position and amplitude of the first pulse. The second pulse is determined by putting $k=2$ in equation (16). Equation (16) means that the second pulse is determined by eliminating the influence casued by the first pulse. The third and the following pulses can be calculated in the same manner, and the pulse calculation is continued until a predetermined number of pulses is obtained or until the value of an error obtained by subtituting the amplitude $g_k$ and position $m_k$ which are calculated as described above into equation (16) becomes below a predetermined threshold value. The $g_k$ and $m_k$ representing the amplitude and the position of the pulse series are outputted from the pulse series calculating circuit 240 through an output terminal 233.

Figure 5A:
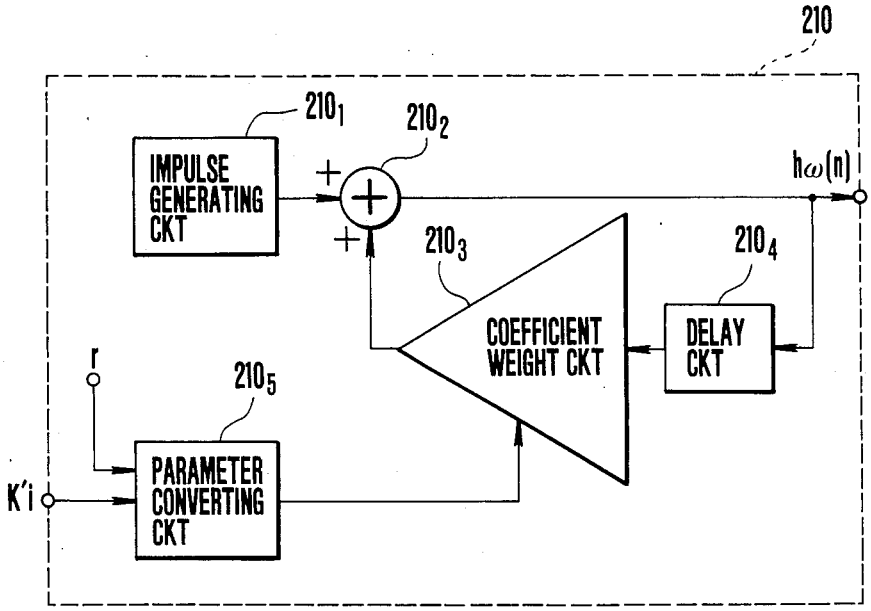
FIG. 5*a* is a block diagram showing one example of an impulse response calculating circuit 210 shown in FIG. 5.

FIG. 5*a* is a block diagram showing one example of the impulse response calculating circuit 210 shown in FIG. 5. In FIG. 5*a*, a parameter converting circuit $210_5$ is inputted with a K parameter decoded value $k_i'$ for converting it into a prediction coefficient value $a_i'$ according to paper No. 3 and for calculating a weighted D 20 predection coefficient value $b_i'$ by using the weighting coefficient r. The relationship between $a_i'$ and $b_i'$ is shown by the following equation $$b_i' = a_i' r^i \tag{20}$$

where $1 \leqq i \leqq P$, and P represents the order number.

The $b_i'$ thus calculated is supplied to a coefficient weighting circuit $210_3$. An addition circuit $210_2$, the coefficient weighting circuit $210_3$ and a delay circuit $210_4$ constitute a synthesizing filter and its transfer function $H\omega(Z)$ is shown by the following equation $$H\omega(Z) = \frac{1}{1 - \sum_{i=1}^{p} a_i' r^i Z^{-i}} \tag{21}$$

The impulse response $h\omega(n)$ has an inverse Z convertion relation with equation (21). In FIG. 5*a*, by generating a unit impulse from an impulse generating circuit $210_1$, the output of adder $210_2$ determines an impulse response of a predetermined number of samples.

Figure 5B:
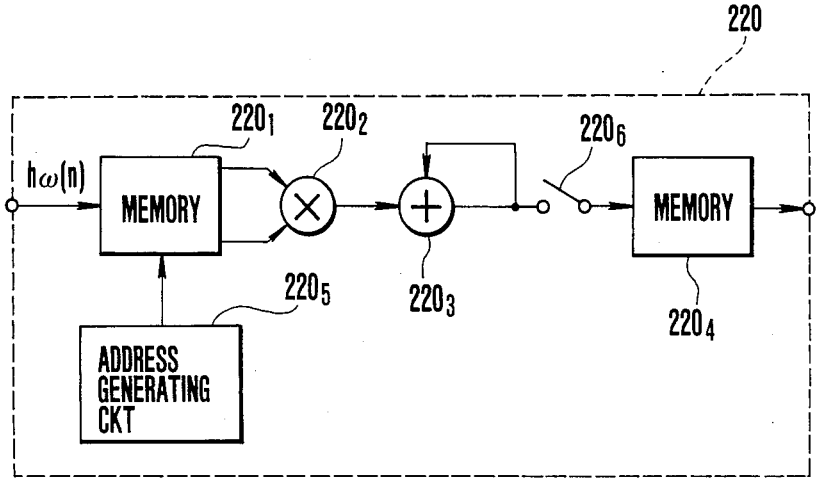
FIG. 5*b* is a block diagram showing one example of an autocorrelation function calculating circuit 220 shown in FIG. 5.

FIG. 5*b* is a block diagram showing one example of the construction of the autocorrelation function calculating circuit 220 shown in FIG. 5. The impulse response $h\omega(n)$ supplied from the impulse response calculating circuit 210 is once stored in a memory device $220_1$ and then the value of $h\omega(n)$ is supplied to a multiplier $220_2$ in accordance with address inforamtion produced by an address generating circuit $220_5$ and an autocorrelation function $\phi hh(\cdot,\cdot)$ is calculated by the multiplexer $220_2$ and an adder $220_3$. A switch $220_6$ is closed when the value of $\phi hh(\cdot,\cdot)$ is established to supply $\phi hh(\cdot,\cdot)$ to a memory device $220_4$ which once stores $\phi hh(\cdot,\cdot)$ and then outputs the same.

Figure 5C:
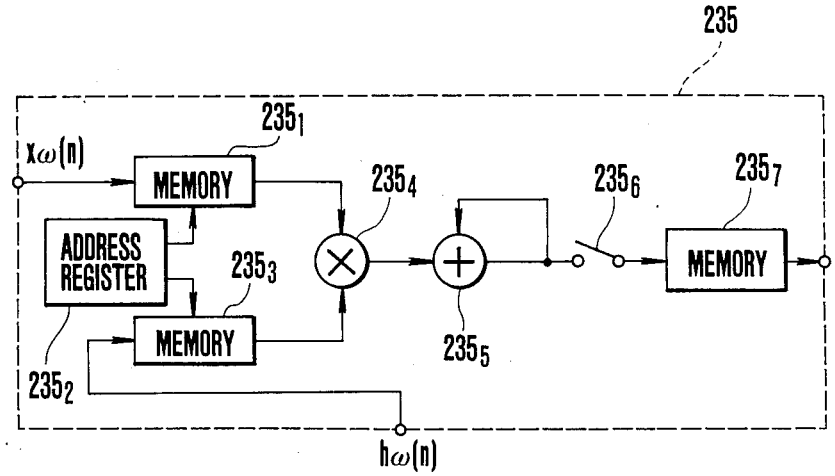
FIG. 5*c* is a block diagram showing one example of a cross-correlation function calculating circuit 235 shown in FIG. 5.

FIG. 5*c* is a block diagram showing one example of the construction of the cross-correlation function calculating circuit 235. In FIG. 5*c* a memory device $\mathbf{235}_1$ is inputted with a weighted signal series $x\omega(n)$, and a memory device $\mathbf{235}_3$ is inputted with an impulse response value $h\omega(n)$. An address register $\mathbf{235}_2$ applies address signals to memory devices $\mathbf{235}_1$ and $\mathbf{235}_3$. A multiplier $\mathbf{235}_4$ and an adder $\mathbf{235}_5$ calculate a cross-correlation function $\phi xh(\cdot)$. A switch $\mathbf{235}_6$ is closed when the values of $\phi xh(\cdot)$ is established to supply the same to a memory device $\mathbf{235}_7$ which once stores $\phi xh(\cdot)$ and then outputs the same.

Figure 5D:
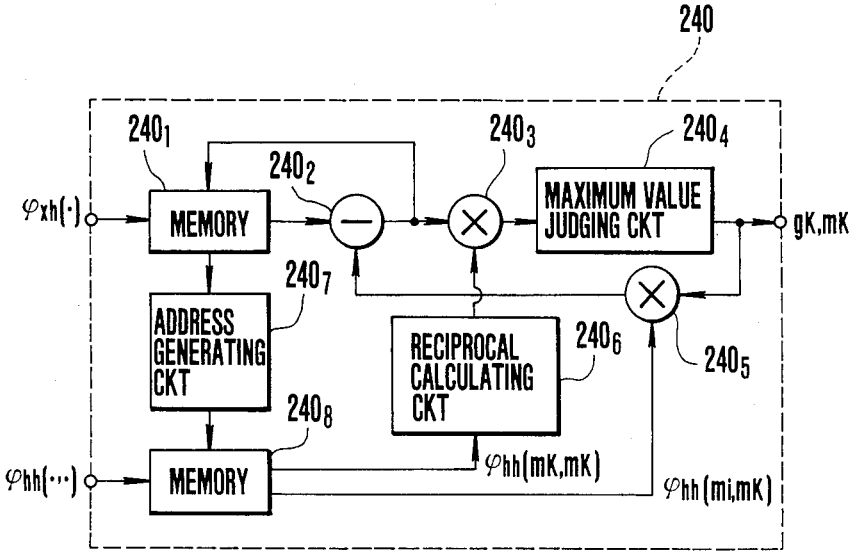
FIG. 5*d* is a block diagram showing one example of a pulse series calculation circuit 240 shown in FIG. 5.

FIG. 5*d* is a block diagram showing one example of the construction of pulse series calculating circuit 240 shown in FIG. 5. In FIG. 5*d*, a memory device $\mathbf{240}_1$ is inputted with and stores a predetermined number of the cross-correlation functions $\phi xh(\cdot)$. A memory device $\mathbf{240}_8$ is inputted with and stores a predetermined number of autocorrelation functions $\phi hh(\cdot, \cdot)$. An address generating circuit $\mathbf{240}_7$ applies address signals to both memory devices $\mathbf{240}_1$ and $\mathbf{240}_8$. A subtractor $\mathbf{240}_2$, multipliers $\mathbf{240}_3$ and $\mathbf{240}_5$ and a reciprocal calculating circuit $\mathbf{240}_6$ calculate the righthand side of equation (16). A maximum value judging circuit $\mathbf{240}_4$ determines the absolute maximum values of the value of righthand side of equation (16) for each $m_k$ so as to determine the optimum position and the optimum amplitude for each pulse. The value of the righthand side of equation (16) is inputted to the memory device $\mathbf{240}_1$ for updating the value stored therein each time a pulse is generated. This updated value is used to search the next pulse. In this manner, the calculated pulse amplitude $g_k$ and pulse position $m_k$ are outputted.

Figure 6A:
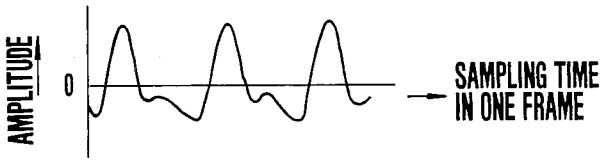
FIGS. 6*a* through 6*e* are waveforms showing the procedures of searching pulses in the pulse calculating circuit 240 shown in FIG. 5.
Figure 6B:
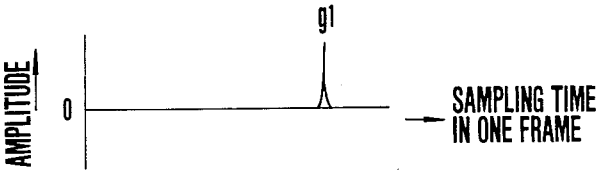
Figure 6C:
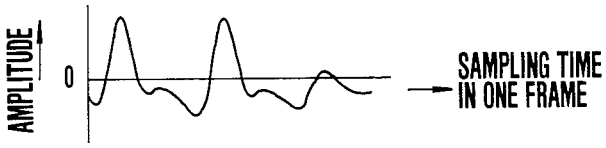
Figure 6D:
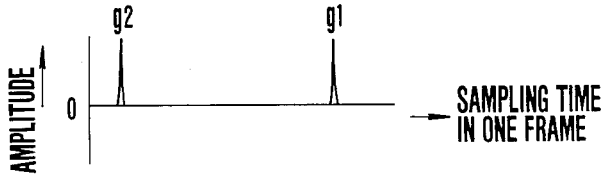
Figure 6E:
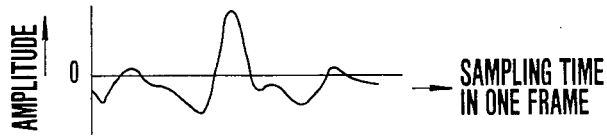

In connection with the tone source pulse calculating circuit 240, the procedure of determining successive pulses according to equation (16) will now be described with reference to FIGS. 6*a* through 6*e*. FIG. 6*a* shows a cross-correlation function of one frame calculated by the cross-correlation function calculating circuit 235 and applied to the pulse calculating circuit 230 in which the abscissa represents the sampling time in one frame, the length of one frame being shown as 160, while the ordinate represents the amplitude. FIG. 6*b* shows the first pulse $g_1$ calculated by equation (16). FIG. 6*c* shows the cross-correlation function after removing the influence of the first pulse shown in FIG. 6*b*. FIG. 6*d* shows the second pulse $g_2$ and FIG. 6*e* shows the cross-correlation function after removing the influence of the second pulse $g_2$. Processings shown in FIGS. 6*d* and 6*e* are repeated until K pulses are obtained.

Figure 7:
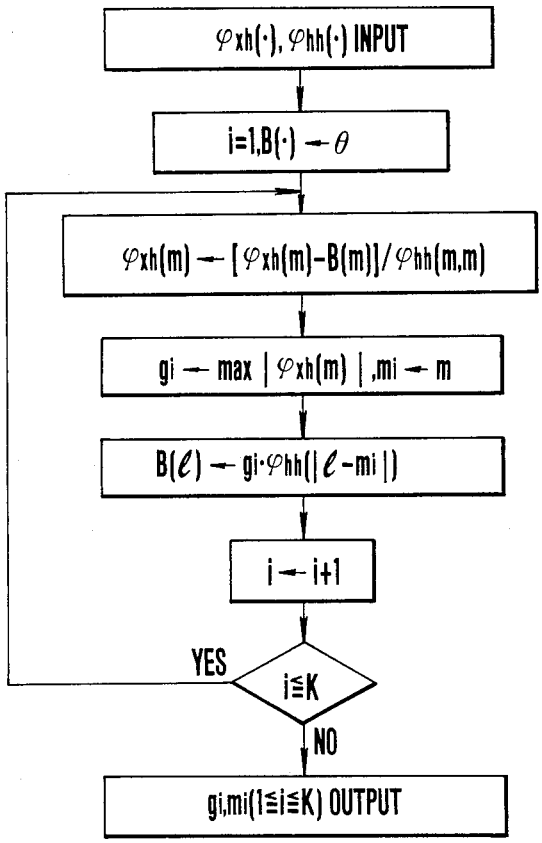
FIG. 7 is a flow chart showing the processings executed in the pulse calculating circuit.

FIG. 7 is a flow chart showing the pulse calculating algorithm shown in equation (16) which is executed by using a microprocessor, for example. This flow chart shows that the amplitude $g_i$ and the position $m_i$ of a pulse can be determined with simple processings.

Referring again to FIG. 4, the encoding circuit 250 is supplied with the amplitude $g_k$ and position $m_k$ of the pulse series from the excitation pulse calculating circuit 230 through its output terminal 233 so as to encode them by utilizing a normalizing coefficient to be described later, thus sending codes representing $g_k$, $m_k$ and the normalizing coefficient to the multiplexer 260. Although various methods can be conceivable for encoding the amplitude $g_k$ can be encoded by any well known method. For example, a method of utilizing an optimum quantizer of the normal type can be used by assuming that the probability distribution of the amplitude is of the normal type. This method is described in detail in J. Max's paper of the title "Quantizing for minimum distortion", IRE transactions on information theory, 1960, March, pages 7 to 12 (hereinafter referred to as paper No. 2). According to another method, after normalizing each pulse amplitude by using the maximum value of the amplitude of the pulse series in one frame as a normalizing coefficient and quantizing and encoding the normalized value. In this method, the root mean square value (r.m.s) or the maximum pulse amplitude in one frame is used as the normalizing coefficient. The encoding of the position of the pulse can be done through various methods. For example, a run length encoding method can be used which is well known in the facsimile signal encoding. According to this method, the length of "0"s in succession is represented by a predetermined code series. To encode the normalizing coefficient, a well known logarithmic compression encoding method can be used.

In addition to the methods of encoding the pulse series described above, the best one of the well known methods can be used.

Referring again to FIG. 4, the multiplexer 260 is inputted with the output code of the K parameter encoding circuit 200 and the output code of the encoding circuit 250 and outputs the combination of the inputs to a communication path through an output terminal 270 on the transmission side.

According to the voice encoding system of this invention, since the calculation of the excitation pulse series is made by using equation (16), it is not necessary to provide a circuit in which a synthesizing filter is driven by a pulse to determine a synthesized signal, error and error power between an original signal and the synthesized signal are determined and these errors are fed back to adjust the pulse as in the paper No. 1. Moreover, as it is not necessary to repeat these series of processings, there are advantages that the amount of calculation can be reduced greatly, and that excellent quality of the synthesized tone can be obtained. Furthermore, in the operation of equation (16), by calculating beforehand the values of $\phi xh(-m_k)$ and $\phi hh(m_i, m_k)$, where $1 \leqq m_i, m_k \leqq N$, for each frame, the operation of equation (16) can be greatly simplified so as to be effected only through multiplying operation and subtraction operation, thus further decreasing the amount of calculation. When compared with a prior art method searching the excitation pulse series, the method of this invention can produce a tone of excellent quality in the case of the same quantity of information transmitted.

Although in the embodiment described above, after all the pulse series have been determined, the excitation pulse series in one frame is encoded by the encoding circuit 250 shown in FIG. 4, the encoding operation can be incorporated into the calculation of the pulse series so as to encode each time a pulse is calculated and then calculate the next pulse. With this construction, it is possible to obtain a pulse series that minimizes error including distortion caused by encoding. This further improves the quality.

Furthermore, in the foregoing embodimet, although the calculation of the pulse series is done in a frame unit, it is also possible to divide one frame into a plurality of subframes for calculating the pulse series for each subframe. With this construction, for a frame length of N, the quantity of calculation can be reduced to about 1/d of that shown in FIG. 4, where d represents the number of frame divisions. Where d=2, for example, the quantity of calculation can be reduced to about ½. Of course, a comparable characteristic can be obtained.

Instead of making constant the frame length as in the foregoing embodiment, the frame length may be made variable, in which case the characteristic can be improved. Although a K parameter was used as a parameter representing the spectrum envelope of a short time voice signal series, another well known parameter can be used, for example LSP parameter. The weighting function $\omega(n)$ in equation (7) may be omitted. Thus in equation (7) it is possible to make $\omega(n)=1$.

In the excitation calculating equation (16), a covariance function $\phi hh(\cdot)$ was calculated with equation (18) but the following equation (22) can be used for calculating the autocorrelation function sequence.

$$\phi hh(|m_i - m_k|) = \sum_{n=1}^{N-(|m_i-m_k|)} h\omega(n)h\omega[(n - |m_i - m_k|)] \quad (22)$$

where $i \leqq |m_i - m_k| \leqq N$

This equation greatly decreases the amount of calculation necessary to calculate $\phi hh(\cdot)$, which in turn reduces the amount of all calculations.

The voice encoding system of this invention is further characterized in that the quality degradation near the frame interface is substantially zero. This will be described with reference to FIG. 8 which is a block diagram showing one example of an encoder utilizing the excitation pulse calculating algorithm according to equation (16).

Figure 2:
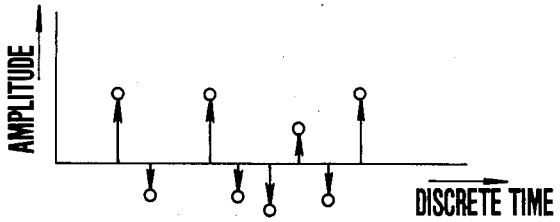
FIG. 2 shows one example of an excitation pulse series.
Figure 8:
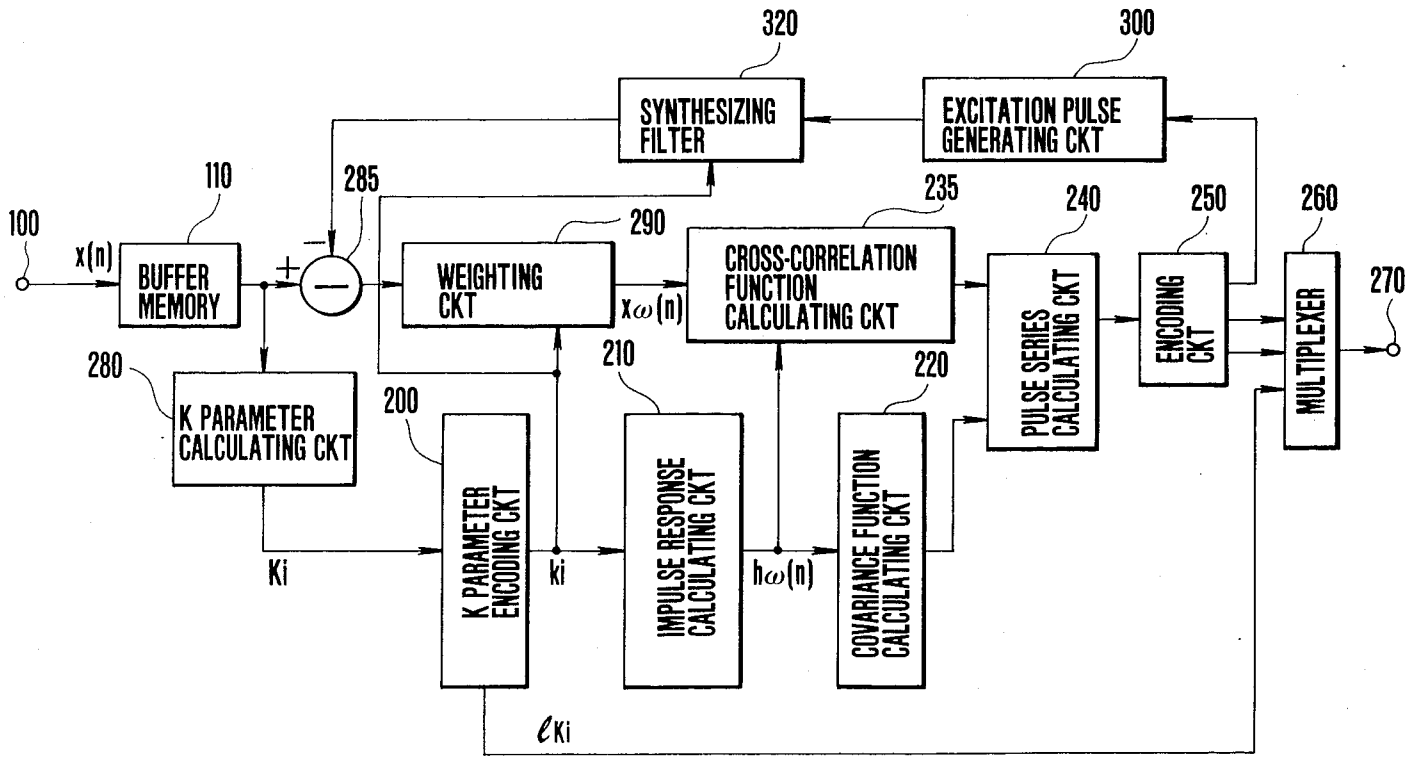
FIG. 8 is a block diagram showing one example of an encoder utilized in the voice encoding system embodying the invention.

In FIG. 8, elements corresponding to those shown in FIG. 1 are designated by the same reference characters. The encoder shown in FIG. 8 executes the following processing in each frame. It is assumed that the sample number in one frame is N. A K parameter calculating circuit 280 is supplied with a voice signal series x(n) stored in a buffer memory device 110 to calculate $N_p$ K parameters $K_i$ ($1 \leqq i \leqq N_p$) of predetermined orders. Parameter $K_i$ is supplied to a K parameter encoding circuit 200. This K parameter encoding circuit 200 encodes $K_i$ in accordance with a predetermined quantizing bit number, for supplying a resulting code $lk_i$ to a multiplexer 260. Furthermore, the K parameter encoder 200 decodes $lk_i$ so as to supply a decodked value k' (where $1 \leqq i \leqq N_p$) to an impulse response calculating circuit 210, a weighting circuit 290 and a synthesizing filter circuit 320. When supplied with $k_i'$, the impulse response calculating circuit 210 calculates $h\omega(n)$ in equation (13) (the impulse response of a filter constituted by cascade connected synthesizing filter and the weighting circuit) by a predetermined sample number and sends the h (n) thus determined to a covariance function calculating circuit 220 and a cross-correlation function calculating circuit 235.

The covariance function calculating circuit 220 is inputted with $h\omega(n)$ of a predetermined sample number for calculating covariance $\phi hh(m_i, m_k)$(where $1 \leqq i, K \leqq N$) of $h\omega(n)$ according to equation (18) and the covariance $\phi hh$ is applied to a pulse series calculating circuit 240. A subtractor 285 subtracts by one frame the output series of the synthesizing filter circuit 320 from the voice signal series x(n) stored in the buffer memory device 110 so as to apply the difference to the weighting circuit 290. As will be described later, the synthesizing filter circuit 320 has been stored with a response signal series by one frame, which response signal series is obtained by using an excitation pulse one frame before the present frame as an excitation signal and thereafter delayed to the present frame by making the excitation signal zero. This is based on a consideration that if it is assumed that the effective sample number of the impulse response of the synthesizing filter is at most about two frames, the voice signal series of the present frame can be expressed by the sum of a signal series obtained by delaying the output signal of the synthesizing filter driven by an excitation pulse one frame before to the present frame by making the excitation signal zero, and the output signal series of the synthesizing filter driven by the excitation pulse series of the present frame.

The weighting circuit 290 is supplied with $K_i'$ from the K parameter encoder 200 for calculating the 7 weighting function $\omega(n)$ according to equation (3) of the prior art system. This can be calculated by using another frequency weighting method. The weighting circuit 290 calculates a convolution integral of the difference from subtractor 285 and $\omega(n)$ to send resulting $x\omega(n)$ to the cross-correlation function calculating circuit 235. This circuit is inputted with $x\omega(n)$ and $h\omega(n)$ and calculates? 3 the cross-correlation function $\phi_{xh}(-m_k)$(where $1 \leqq m_k \leqq N$) according to equation (17). The cross-correlation function thus calculated is sent to the pulse series calculating circuit 240.

The pulse series calculating circuit 240 is supplied with $\phi_{xh}(-m_k)$ from the cross-correlation function calculating circuit 235 and $\phi hh(m_i, m_k)$ (where $1 \leqq m_i, m_k \leqq = N$) from the covariance function calculating circuit 220 to calculate the amplitude $g_k$ of the pulse by using equation (16) for calculating the excitation pulse. For example, the amplitude $g_1$ of the first pulse is calculated as a function of position $m_1$ by putting $k=1$ in equation (16).

Then $m_1$ that maximizes $|g_1|$ is selected to determine the position $m_1$ and amplitude $g_1$ of the first pulse. The second pulse is determined by putting $k=2$ in equation (16). Equation (16) means that the second pulse is determined by eliminating the influence caused by the first pulse. The third and following pulses can be calculated in the same manner and the pulse calculation is continued until a predetermined number of pulses are obtained or until the value of error obtained by substituting $g_k$ and $m_k$ of the pulse in equation (16) becomes less than a predetermined threshold value. Signals $g_k$ and $m_k$ representing the amplitude and position of the pulse series are sent to an encoding circuit 250.

The encoding circuit 250 is supplied with the amplitude $g_k$ and the position $m_k$ of the excitation pulse series from the excitation pulse calculating circuit 240 to encode these signals by using a normalizing coefficient to be described later for sending codes representing $g_k$ and $m_k$ and the normalizing coefficient to the multiplexer 260. The $g_k$ and $m_k$ are then decoded and decoded values $g_k'$ and $m_k'$ are sent to a pulse series generating circuit 300. Many methods of encoding the amplitude $g_k$ may be considered and a well known method for this purpose may be employed.

In addition to the methods described above, any well known best method can be used.

Turning back to FIG. 8, the pulse series generating circuit 300 generates an excitation pulse series of one frame having an amplitude $g_k'$ at a position $m_k'$, by using inputted $g_k'$ and $m_k'$ supplies the generated excitation pulse series to the synthesizing filter 320 which is supplied with a K parameter decoded value $K_i'$ (where $1 \leqq i \leqq N_p$) from the K parameter encoding circuit 200 and converts $K_i'$ into a prediction parameter $a_i$ (where $1 \leqq i \leqq N_p$) by a well known method. The synthesizing filter 320 is supplied with an excitation signal of one frame from the pulse generating circuit 300 to add zero of one frame to this signal of one frame, thereby determining a response signal series x' (n) for the signals of two frames. When calculating a response signal series in accordance with the zero signal series of the second frame, the synthesizing filter circuit 320 is inputted with a new $K_i'$ (where $1 \leqq = i \leqq = N_p$) from the K parameter encoding circuit 200. This is shown by the following equation (19).

$$\tilde{x}'(n) = d(n) + \sum_{i=1}^{Np} a_i^{j-1}\tilde{x}'(n-i) \text{ (where } 1 \leqq n \leqq N) \tag{19}$$

$$\tilde{x}'(n) = d(n) + \sum_{i=1}^{Np} a_i^{j}\tilde{x}'(n-i) \text{ (where } N+1 \leqq n \leqq 2N)$$

where the excitation signal d(n) represents the output pulse signal generated by the pulse generating circuit 300 when $1 \leqq = n \leqq = N$, whereas represents a series of all zero when $N+1 = \leqq n \leqq 2N$. Further, in equation (19), $a_i^j$ represents the prediction parameter calculated from $K_i'$ (where $1 \leqq i \leqq N_p$)at the present frame time j and $a_i^{j-1}$ represents the prediction parameter calculated from $K_i'$ at a frame time j−1 which is one frame before. Among $\tilde{x}'(n)$ calculated with equation (19), the $\tilde{x}'(n)$ of the second frame (where $N+1 \leqq n \leqq 2N$) is supplied to the subtractor 285.

The multiplexer 260 is inputted with the output code of the K parameter encoder 200 and the output code of the encoder 250 and combines these two codes to send the resulting combination to the transmission path through an output terminal 270 on the transmission side.

Figure 9A:
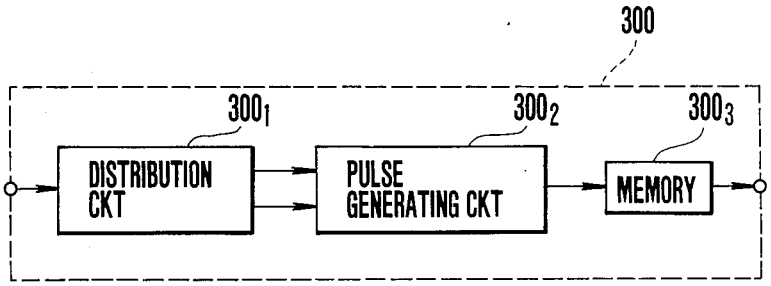
FIG. 9*a* is a block diagram showing one example of the construction of an excitation generating circuit 300 shown in FIG. 8.

One example of the construction of the excitation pulse generating circuit 300 shown in FIG. 8 is illustrated in FIG. 9*a* which comprises a distribution circuit $300_1$ inputted with the amplitude decoded value and the position decoded value of the excitation pulse, and then separates them for applying position information and amplitude information to a pulse generating circuit $300_2$. The pulse generating circuit $300_2$ generates a predetermined number of pulses according to the position information and amplitude information supplied thereto, thus determining a driving signal series in which a sampling position at which no pulse is generated is made 0 (zero). The driving signal series is supplied to a memory device $300_3$ which stores the driving signal series of one frame and then outputs it.

The construction and operation of the synthesizing circuit 320 shown in FIG. 8 are described in chapters 1 and 5 of a text book written by J. D. Markel et al of the title "Linear Prediction of Speech" published by Springer - Verlag Co. in 1976.

The decoder of the voice decoding system of this invention will now be described with reference to FIG. 10 in which a code series of each frame is inputted to a demultiplexer 360 through an input terminal 350. The demultiplexer 360 separates the code series into a K parameter code series, a code series representing the amplitude and position of the excitation pulse series, and a code representing a normalizing coefficient for sending the K parameter code series to a K parameter decoder 380 and the remaining code series to a decoder 370. The decoder 370 first decodes the code representative of the normalizing coefficient, decodes the codes the code series of the excitation pulse series by using the former code, and outputs the amplitude $g_k'$ and position $m_k'$ of the pulse to the pulse series generating circuit 420.

Figure 10:
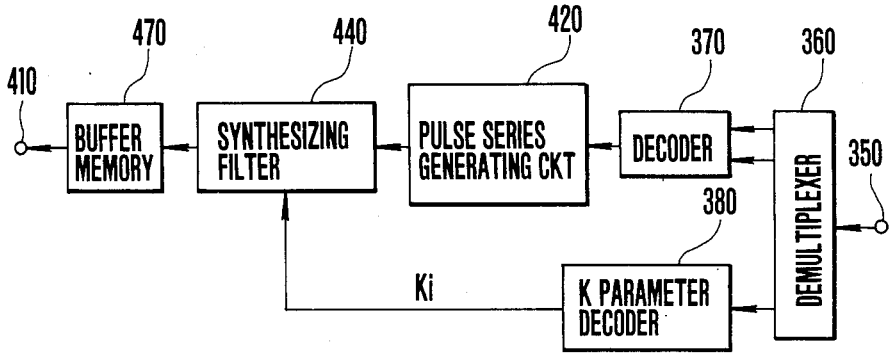
FIG. 10 is a block diagram showing one example of a decoder utilized in the voice encoding system embodying the invention.

The excitation pulse generating circuit 420 shown in FIG. 10 operates in the same manner as the circuit 300 shown in FIG. 8 for producing a pulse series in one frame which is sent to a synthesizing filter 440. The synthesizing filter 440 is supplied with the $N_p$K parameter decoded values $K_i'$ (where $1 \leqq = i \leqq = N_p$) from the K parameter decoding circuit 380 for converting them into a prediction parameter $a_i$ (where $1 \leqq i \leqq N_p$) Then the synthesizing filter 440 is supplied with an excitation signal of one frame from the pulse series generating circuit 420 for regenerating the voice signal series of one frame from the excitation signal.

In the synthesizing filter 440, the response signal series determined by the excitation pulse series one frame before is added to a synthesized signal series determined by the excitation pulse signal of the present frame so as to synthesize the voice signal series. The synthesized voice signal series $\bar{x}(n)$ is applied to a buffer memory device 470 which stores the $\bar{x}(n)$ of one frame and then outputs the same through an output terminal 410 on the decoder side.

Figure 9B:
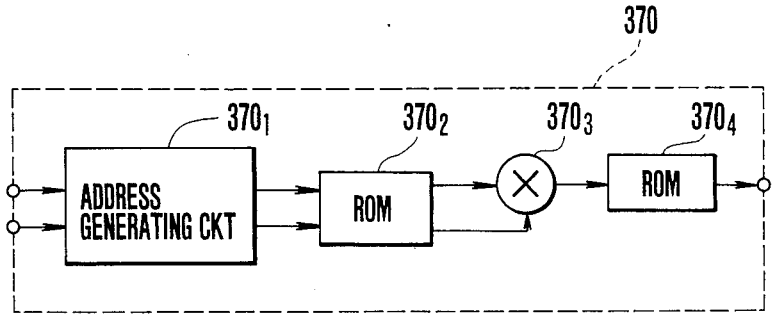
FIG. 9*b* is a block diagram showing a decoding circuit 370 utilized in the voice encoding system of this invention.
Figure 9C:
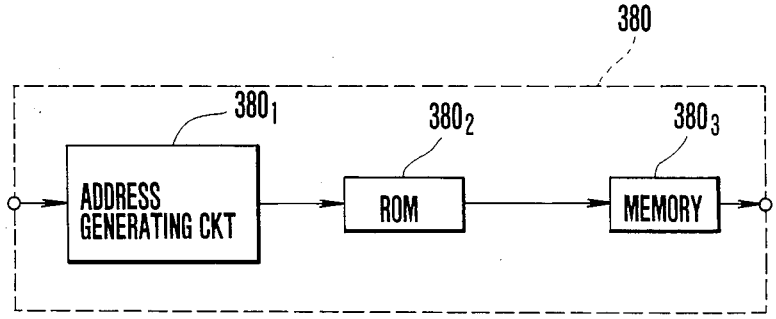
FIG. 9*c* is a block diagram showing one example of the K parameter decoding circuit 380 shown in FIG. 8.

The decoder 370 shown in FIG. 10 functions oppositely to the encoding circuit 250 in FIG. 8. One example of the construction of decoder 370 is illustrated in FIG. 9*b*. In the figure, an address generating circuit $370_1$ is supplied with a code representative of the amplitude and position of the excitation pulse series for generating an address for a ROM $370_2$. The ROM $370_2$ receives the address and outputs a value corresponding to the address to a multiplier $370_3$. The address generating circuit $370_1$ also receives a code representative of the normalizing coefficient and generates an address for the ROM $370_2$, which receives the address to deliver a value corresponding thereto to the multiplier $370_3$. The multiplier $370_3$ then sends a result of multiplication (decoded value) to a ROM $370_4$ which once stores the result and then outputs the same. The K parameter decoding circuit 380 shown in FIG. 10 functions oppositely to the K parameter encoding circuit 200 shown in FIG. 8. One example of the construction is shown in FIG. 9c. in which an address generating circuit $380_1$ is inputted with a code representing the K parameter for sending an address signal to a ROM $380_2$. The ROM $380_2$ stores decoded values according to a predetermined decoding characteristics and supplies a decoded value corresponding to the input address signal to a memory device $380_3$. The memory device $380_3$ once stores the decoded value and then outputs the same.

According to the voice encoding system of this invention, since the excitation pulse series is calculated with equation (16), it is not necessary to provide a circuit as in the paper No. 1 in which a synthesizing filter is driven by a pulse for producing a synthesized signal, and error and error power between an original signal and the synthesized signal are fed back to adjust the pulse. Moreover, as it is not necessary to repeat the processings, the amount of calculation can be reduced greatly and an excellent quality of the synthesized tone can be obtained. When operating equation (16), as the values $\phi xh(-m_k)$ and $\phi hh(m_i, m_k)$(where $1 \leqq m_i$ and $m_k \leqq = N$) of each frame are calculated beforehand, the calculating operation of equation (16) can be greatly simplied, requiring only multiplying and subtracting operations, which further decreases the amount of calculation. When compared with other prior art system of searching the excitation pulse series, the system of this invention can produce more excellent quality for the same quantity of information being transmitted.

The system of this invention has an advantageous effect that the degradation of the synthesized signal near the boundaries of the frames caused by the discontinuity of the waveform is very small irrespective of whether the analysed frame length is constant or not. This effect is caused by the fact that, when calculating the excitation pulse series of the present frame, a response signal series obtained by driving the synthesizing filter with an excitation pulse series one frame before is delayed or extended to the present frame, and the result obtained by subtracting the delayed excitation pulse series from an input voice signal series is used as a target signal series for calculating the excitation pulse series of the present frame. This effect is also caused by synthesizing the voice signal series by using as an excitation a signal series synthesized by decoding a received signal on the side of the decoder and a response signal series generated from an excitation pulse series one frame before.

The embodiment shown in FIG. 8 has the same advantage as the first embodiment.

Although in FIG. 8, the subtractor 285 is disposed on the output side of the buffer memory device 110, the subtractor may be palced before the buffer memory device. Furthermore, in FIG. 8 although the parameter calculating circuit 280 is connected to the input side of subtractor 285 for analyzing the output series of the buffer memory device, if desired, the K parameter calculating circuit 280 may be connected on the output side of the subtractor 285 for analyzing the output thereof.

Assume now that the input voice signal series is stationary, the covariance function $\phi hh(m_i, m_k)$ shown by equation (17) can be put to be equal to the autocorrelation funtion Rhh(·) relying upon a delay ($|m_i-m_k|$) as shown by the following equation.

$$\phi hh=(m_i, m_k)=Rhh(m_i-m_k|) \tag{23}$$

in which Rhh(·) represents the autocorrelation function of $h\omega(n)$ and can be expressed by the following equation:

$$Rhh(|m_i-m_k|)=\sum_{n=1}^{N-(|m_i-m_k|)} h\omega(n)h\omega[n-(|m_i-m_k|)] \tag{24}$$

where $1 \leqq |m_i-m_k| \leqq N$.

Accordingly, equation (16) can be modified as follows by using equations (17), (23) and (24)

$$g_k(m_k)=\frac{\phi xh(-m_k)-g_1Rhh(m_1-m_k)-\ldots-g_{k-1}Rhh(m_{k-1}-m_k)}{\text{I Rhh}(\cdot)} \tag{25}$$

The amount of calculation Rhh(·) is about 1/N of that of $\phi hh(\cdot,\cdot)$. Consequently by using equation (25) for the calculation of the excitation pulse series, the amount of calculation can be reduced to about 1/N. However, when calculating Rhh($|m_i-m_k|$) shown in equation (24), as the delay time ($|m_i-m_k|$) approaches the data number N (in this case it is equal to the frame length) utilized for calculating equation (24), the value of Rhh(·) deviates from true value, whereby the error from the true value increases. Since this error becomes remarkable where the power of the input voice signal series varies greatly from the end of one frame to the next frame, the error becomes large at the end of the frame of the excitation pulse series calculated by using equation (21), thus making inaccurate the excitation pulse series, with the result that the quality of the synthesized voice would be impaired. With the voice code encoding system according to this invention, since the analyzing frame utilized for calculating the excitation pulse series is made longer than the transmission frame for transmitting a pulse and moreover the analyzing frames are overlapped, it is possible to minimize the error.

Figure 11:
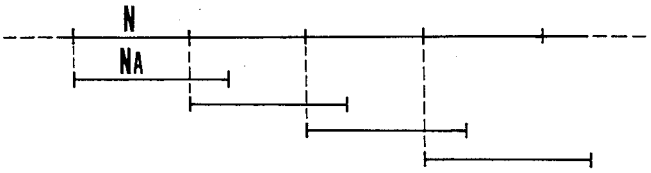
FIG. 11 shows the relationship between the transmission frames and the analyzing frame.

FIG. 11 shows the relationship between the transmission frame and the analyzing frame. In FIG. 11, a straight line depicted at the upper portion shows sectionalization of the transmission frame (sample number N). Among the excitation pulse series calculated by equation (25), those lying within the sections are transmitted. Straight lines at the lower portion show analyzing frames (sample numbers NA, NA . . . NA). In other words, when calculating equations (17), (24) and (25), N is replaced by NA and the calculation of the excitation pulse series is executed by using this NA sample.

One of the characteristics of the voice encoding system of this invention lies in that the quality degradation near the boundaries of the frames is negligibly small.

Figure 12:
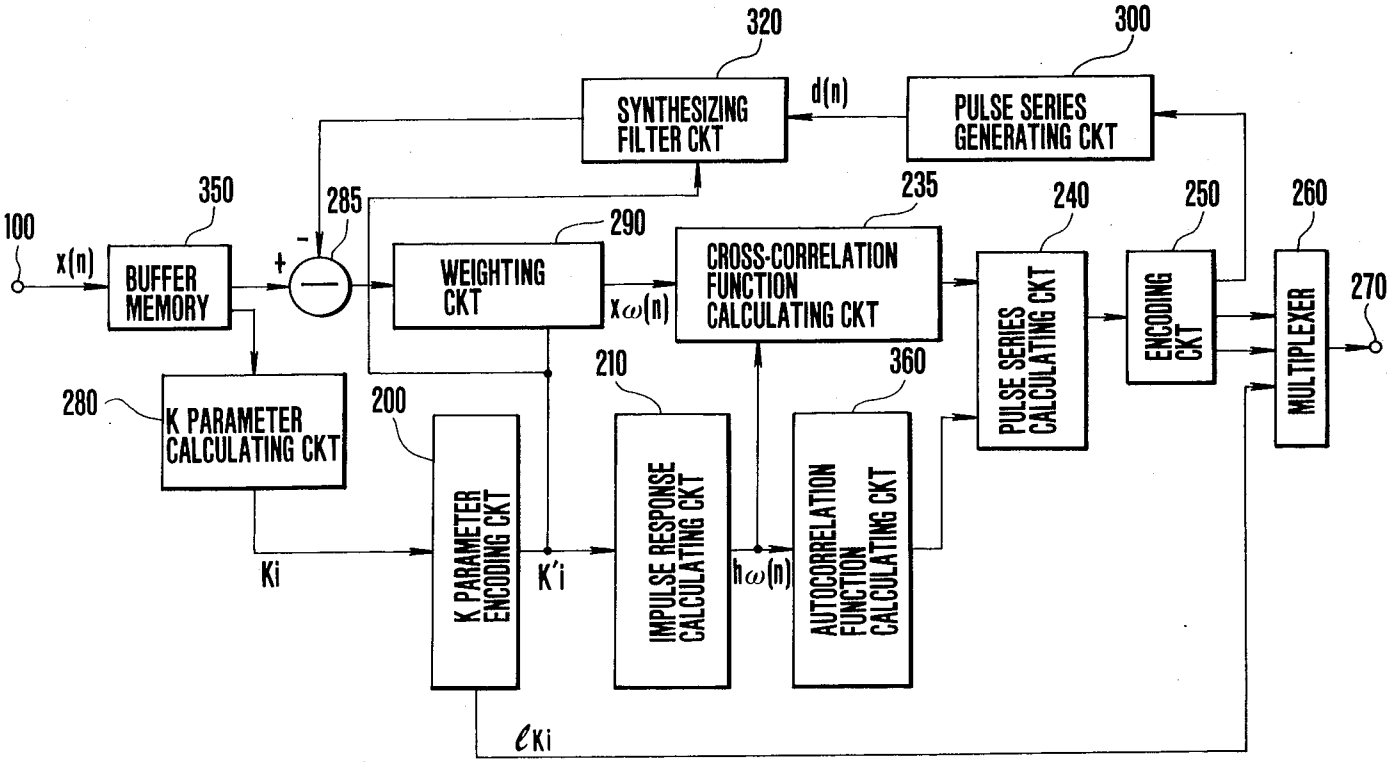
FIG. 12 is a block diagram showing another example of the encoder utilized in the voice encoding system according to this invention.

FIG. 12 is a block diagram showing one embodiment of the voice encoder of this invention utilizing the excitation pulse series calculating algorithm according to equation (25), in which elements corresponding to those shown in FIG. 1 are designated by the same reference symbols. A buffer memory circuit 350 stores the input voice signal series x(n) of the sample number NA. When sectionalizing the input voice signal series into a number of sections each containing NA samples, the input voice signal series is sectionalized such that the sections overlap with each other by predetermined sample numbers. This is the same as in FIG. 11. A K parameter calculating circuit 280 is inputted with a series of a predetermined length among the voice signal series x(n) stored in the buffer memory circuit 350 for calculating $N_p$ K parameters $K_i$ (where $1 \leqq i \leqq N_p$) of a predetermined order. The K parameter $K_i$ is applied to a K parameter encoding circuit 200 which encodes $K_i$ according to a predetermined number of quantizing bits so as to apply a code $lK_i$ to a multiplexer 260. Further, the encoding circuit 200 decodes $lK_i$ to supply the decoded value $K_i'$ (where $1 \leqq i \leqq N_p$) to an impulse response calculating circuit 210, a weighting circuit 290, and a synthesizing filter circuit 320. In response to the inputted $K_i'$, the impulse response calculating circuit 210 calculates, by a predetermined number of samples, $h\omega(n)$ (the impulse response of filter comprising cascade connected synthesizing filter and weighting circuit) in equation (13) and sends $h\omega(n)$ thus determined to an autocorrelation function calculating circuit 360 and a cross-correlation function calculating circuit 235.

The autocorrelation function calculating circuit 360 is inputted with $h\omega(n)$ of a predetermined number of samples for calculating the autocorrelation function $Rhh(m_i-m_k)$ of $h\omega(n)$ according to equation (20) to send the autocorrelation function $Rhh(m_i-m_k)$ to a pulse series calculating circuit 240.

A subtractor 285 is inputted with the voice signal series x(n) stored in the buffer memory circuit 350 and subtracts therefrom the output series of the synthesizing filter circuit 320 by one analyzing frame NA so as to send the result of subtraction to the weighting circuit 290. As will be described later, the synthesizing filter circuit 320 has been stored with a response signal series by one analyzing frame NA, which response signal series is obtained by utilizing an excitation pulse series one transmission frame before the present frame as an excitation signal and then delayed to the present frame by making zero the excitation signal. This is based on a consideration that if it is assumed that the number of effective samples of the impulse response of the synthesizing filter circuit is at most about 2 frame, the voice signal series of the present frame can be expressed by the sum of a signal series obtained by delaying the output signal of the synthesizing filter circuit driven by a voice pulse one frame before to the present frame by making zero the excitation signal and the output signal series of the driving filter circuit driven by the voice pulse series of the present frame. The weighting circuit 290 is inputted with $K_i$ from the K parameter encoding circuit 200 to calculate the weighting function $\omega(n)$ with equation (3) of the prior art system. This calculation can be made by another frequency weighting method. Also the weighting circuit 290 is inputted with the result of subtraction executed by subtractor 285 and executes a convolution integration of this difference and $\omega(n)$ so as to apply the resulting $x\omega(n)$ to a cross-correlation function calculating circuit 235. In response to $x\omega(n)$ and $h\omega(n)$, the cross-correlation function calculating circuit 235 calculates a cross-correlation function $\phi xh(-m_k)$ (where $1 \leqq m_k \leqq N$) in accordance with equation (17) to send this cross-correlation function to the pulse series calculating circuit 240. The pulse series calculating circuit 240 is supplied with $\phi xh(-m_k)$ from the cross-correlation function calculating circuit 235 and $Rhh(|m_i-m_k|)$ (where $1 \leqq |m_i-m_k| \leqq N$) from the autocorrelation function calculating circuit 360 to calculate the amplitude $g_k$ of the pulse by using equation (25) for calculating the excitation pulse. For example, in the first pulse, the amplitude $g_1$ is calculated as a function of the position $m_1$ by putting $K=1$ in equation (25). Then the $m_1$ that maximizes $|g_1|$ is selected and $m_1$ and $g_1$ thus obtained are used as the position and amplitude of the first pulse. The amplitude and position of the second pulse can be determined by putting $K=2$ in equation (25). Equation (25) means that the second pulse is determined by eliminating the effect caused by the first pulse. The third and succeeding pulses can be calculated in the same manner. The calculation is continued until a predetermined number of pulses are obtained, or until the value of error obtained by substituting $g_k$ and $m_k$ of the pulse thus determined in equation (15) becomes below a predetermined threshold value. Thereafter $g_k$ and $m_k$ representing the amplitude and position of the pulse series are sent to an encoding circuit 250.

Although the calculation of the excitation pulse series is executed with reference to the length NA of the analyzing frame, regarding the pulse series (the position $m_k$ of the pulse satisfying a relation $1 \leqq m_k \leqq N$) contained in a transmission frame N, its amplitide $g_k$ and position $m_k$ are sent to the encoding circuit 250.

The encoding circuit 250 is supplied with the amplitude $g_k$ and the position $m_k$ of the excitation pulse series from the excitation pulse calculating circuit 240 to encode these signals by using a normalizing function to be described later for sending $g_k$, $m_k$ and a code representing the normalizing coefficient to the multiplexer 260. Further, it supplies the decoded values $g_k'$ and $m_k'$ of $g_k$ and $m_k$ to a pulse series generating circuit 300. Although various encoding methods can be considered, the encoding of the amplitude can be made with a well known method.

In addition to the methods of encoding the pulse series described above, any well known best method can be used.

Figure 13:
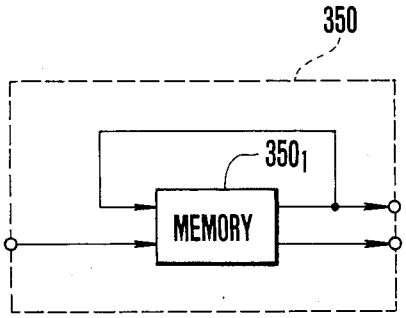
FIG. 13 is a block diagram showing one example of the construction of a buffer memory circuit 350 shown in FIG. 12.

The construction of the buffer memory circuit 350 shown in FIG. 12 is illustrated in FIG. 13. It comprise a memory device $350_1$ which stores the data in 0-th to $(N_A-N-1)$-th the addresses obtained by shifting the data stored at the N-th address through $(N_A-1)$-th addresses at each predetermined time. Thereafter, the voice signal series is sampled N times to store them at $(N_A-N)$-th through $(N_A-1)$-th addresses. Then the data of $N_A$ samples are read out of 0-th through $(N_A-1)$-th addresses to output them through an upper output terminal. Furthermore, the data of N samples are read out of the 0-th through (N-1)-th addresses and outputted through a lower output terminal.

Referring again to FIG. 12, the pulse series calculating circuit 300 is inputted with $g_k'$ and $m_k'$ to calculate an excitation pulse series having an amplitude $g_k'$ at the position $m_k'$ over one transmission frame length N and sends the calculated excitation pulse series to the synthesizing filter circuit 320 as an excitation signal. The synthesizing filter circuit 320 is supplied with a K parameter quantized value $K_i'$ (where $1 \leqq i \leqq N_p$) from the K parameter encoding circuit 200 for converting the K parameter quantized value $K_i'$ into a prediction parameter $a_i$ (where $1 \leqq i \leqq N_p$) by using a well known method. The synthesizing filter circuit 320 operates in the same manner as the circuit 320 in FIG. 8.

The multiplexer 260 combines the output code from the K parameter encoding circuit 200 and the output code of the encoding circuit 250 so as to output the combined code to the transmission path through an output terminal 270 on the transmission side.

The operation of the decoder of the voice encoding system of this invention is as follows. In the calculation of equation (25), by calculting beforehand the values of $\phi xh(-m_k)$ and $Rhh(|m_i-m_k|)$ where $(1 \leqq |m_i-m_k| \leqq N)$ for each one transmission frame, the calculation of equation (25) can be greatly simplified, requiring only multiplying and subtraction operations. This further decreases the amount of calculation. When compared with other prior art system of searching the excitation pulse series, the method of this invention can obtain more excellent signal quality in case where the same information quantity is transmitted.

With the construction of this invention, since in the calculation of the excitation pulse series by using equations (17), (24) and (25), a sample of an analyzing frame lengh $N_A$ longer than the transmission frame length N is used and these samples are overlapped with each other for the analysis made at the next frame time, the error occurring at the time of calculating Rhh(·) in equation (25) can be made very small so that at the end of the frame, the excitation pulse can be determined accurately, whereby a synthesized tone has high quality.

Furthermore, in the encoder shown in FIG. 12, after drivng the synthesizing filter circuit 320 by an excitation pulse series determined one transmission frame before, all of one analyzing frame is inputted to the zero excitation pulse series and the response signal series is delayed to the present frame. In this case, when the synthesizing filter is driven by an excitation pulse series one transmission frame before, the K parameter value inputted one transmission frame before was used as it is. But where all of zero excitation pulse series of one analyzing frame is inputted, the K parameter value inputted at the present frame time is used. Even when an excitation pulse series in which all pulses are zero in one analyzing frame is inputted, the K parameter value one transmission frame before can be used as it is as the K parameter value of the synthesizing filter circuit 320.

While, in the foregoing description, the excitation pulse series in one transmission frame was encoded by the encoding circuit 250 shown in FIG. 12, the encoding can be included in the calculation of the pulse series after all pulse series have been determined so that each time one pulse is calculated, it is encoded and then the next pulse is calculated. With such a modified construction, a pulse series can be determined in which error including the distortion of encoding is the minimum, which further improves the quality:

As before, instead of calculating the pulse series in frame unit, the frame can be divided into a number of subframes for decreasing the amount of calculation.

What is claimed is:

1. An apparatus for encoding voice signals comprising:

means inputted with a discrete voice signal series for dividing said voice signal series at each time interval to obtain a time interval voice signal series;

means for extracting a parameter representative of a spectrum envelope from said time interval voice signal series and encoding the parameter;

means for calculating an impulse response series based on said parameter representative of said spectrum envelope;

means for calculating an autocorrelation function sequence of said impulse response series;

means for calculating a cross-correlation function sequence between said impulse response series and said time interval voice signal series;

means for calculating and encoding an excitation signal series of said time interval voice signal series by using said autocorrelation function sequence and said cross-correlation function sequence; and means for combining and outputting a code of said parameter representative of said spectrum envelope and a code representative of said excitation signal series.

2. An apparatus for encoding voice signals comprising:

means inputted with a discrete voice signal series for dividing said voice signal series at each time interval to obtain a time interval voice signal series;

means for extracting a parameter representative of a spectrum envelope from said short time voice signal series and encoding the parameter;

means for calculating an impulse response series based on a spectrum envelope parameter which is said parameter representative of said spectrum envelope subjected to a predetermined correction based on said time interval voice signal series;

means for calculating an autocorrelation function sequence of said impulse response series;

means for calculating a target signal series which has been subjected to said predetermined correction based on said time interval voice signal series;

means for calculating a cross-correlation function sequence between said impulse response series and said target signal series;

means for calculating and encoding an excitation signal series of said time interval voice signal series by using said autocorrelation function series and said cross-correlation function series; and means for combining and outputting a code of said parameter representative of said spectrum envelope and a code representative of said excitation signal series.

3. A method of encoding voice signals comprising the steps of:

inputting a discrete voice signal series on a transmission side;

dividing said voice signal series at each time interval to obtain a time interval voice signal series;

subtracting a response signal series synthesized by a determined excitation signal series in a time interval voice signal series previous to said time interval voice signal series and forming a target signal series based on the result of said subtraction;

extracting and encoding a parameter representative of a spectrum envelope of one of said time interval voice signal series and a spectrum envelope of the result of said subtraction;

determining an impulse response series based on the parameter representative of said spectrum envelope and calculating an autocorrelation function sequence of said impulse response series;

determining and encoding an excitation signal series of said voice signal series by using said autocorrelation function sequence and said cross-correlation function sequence;

forming a response signal series originating from said excitation signal series;

combining and outputting a code series of parameter representative of said spectrum envelope and a code series of said excitation signal series;

inputting said code series on a receiving side and separating said code series of said excitation signal series and said code series of said parameter representative of said spectrum envelope;

decoding said excitation signal series from said separated code series and producing an excitation signal series;

decoding said separated code series of said parameter representative of said spectrum envelope;

synthesizing a voice signal series by using said decoded parameter and said produced excitation signal series;

calculating a response signal series synthesized by a decoded excitation signal series for a time interval voice signal series previous to said time interval voice signal series; and adding together said response signal series and said synthesized voice signal series to output the result of said addition.

4. An encoding and decoding apparatus comprising:

a subtracting circuit inputted with a discrete voice signal series and subtracting a response signal series from said voice signal series;

a parameter calculating circuit extracting and encoding a parameter representative of a spectrum envelope of one of said time interval voice signal series and a spectrum envelope of the output series of said subtracting circuit;

an impulse response series calculating circuit for calculating an impulse response series by subjecting said parameter representative of said spectrum envelope to a predetermined correction;

an autocorrelation function sequence calculating circuit inputted with the output series of said impulse response series calculating circuit for calculating an autocorrelation function sequence;

a cross-correlation function calculating circuit for calculating a cross-correlation function sequence between said impulse response series and a signal series obtained by subjecting said output series of said subtracting circuit to said predetermined correction;

an excitation signal series calculating circuit inputted with said autocorrelation function sequence and said cross-correlation function sequence for calculating and encoding said excitation signal series of said voice signal series;

a response signal series calculating circuit inputted with said excitation signal series for calculating said response signal rates series originating from said excitation signal series;

a multiplexer circuit for combining and outputting the output code series of said parameter calculating circuit and the code series of said excitation signal series;

a demultiplexer circuit inputted with a code series formed by combining an output code series of a parameter calculating circuit and a code series of said excitation signal series for separating a code series representative of said excitation signal series and a code series of a parameter representative of said spectrum envelope;

an excitation pulse series generating circuit for decoding said separated code series representative of said excitation signal series for generating an excitation series;

a decoding circuit for decoding said separated code series of said parameter representative of said spectrum envelope; and a synthesizing filter circuit inputted with the output series of said excitation signal series generating circuit for synthesizing and outputting a voice signal serie s by using the output parameter of said decoding circuit.

5. An encoding and decoding apparatus comprising:

a subtracting circuit inputted with a discrete voice signal series and subtracting a response signal series from said voice signal series;

a parameter calculating circuit extracting and encoding a parameter representative of a spectrum envelope of one of said time interval voice signal series and a spectrum envelope of the output series of said subtracting circuit;

an impulse response series calculating circuit for calculating an impulse response series from said parameter representative of said spectrum envelope;

an autocorrelation function sequence calculating circuit inputted with the output series of said impulse response series calculating circuit for calculating an autocorrelation function sequence;

a cross-correlation function calculating circuit for calculating a cross-correlation function sequence between said impulse response series and a signal series obtained from said output series of said subtracting circuit;

an excitation signal series calculating circuit inputted with said autocorrelation function sequence and said cross-correlation function sequence for calculating and encoding said excitation signal series of said voice signal series;

a response signal series calculating circuit inputted with said excitation signal series for calculating said response signal series originating from said excitation signal series;

a multiplexer circuit for combining and outputting the output code series of said parameter calculating circuit and the code series of said excitation signal series;

a demultiplexer circuit inputted with a code series formed by combining an output code series of a parameter calculating circuit and a code series of said excitation signal series for separating a code series representative of said excitation signal series and a code series of a parameter representative of said spectrum envelope;

an excitation pulse series generating circuit for decoding said separated code series representative of said excitation signal series for generating an excitation series;

a decoding circuit for decoding said separated code series of said parameter representative of said spectrum envelope; and a synthesizing filter circuit inputted with the output series of said excitation signal series generating circuit for synthesizing and outputting a voice signal series by using the output parameter of said decoding circuit.

* * * * *

UNITED STATES PATENT AND TRADEMARK OFFICE

CERTIFICATE OF CORRECTION

PATENT NO. : 4,716,592

DATED : December 29, 1987

INVENTOR(S) : OZAWA

It is certified that error appears in the above-identified patent and that said Letters Patent is hereby corrected as shown below:

Column 5, lines 52-55, delete $$W(z) = \left(1 - \sum_{i=1}^{g} a_i z^{-i}\right) / \left(1 - \sum_{i=1}^{g} a_i' - z^{-i}\right) \quad (3)$$

Insert

-- $$W(z) = \left(1 - \sum_{i=1}^{g} a_i z^{-i}\right) / \left(1 - \sum_{i=1}^{g} a_i' - z^{-i}\right) \quad (3)$$ --

Column 7, line 38, delete "x(n)*" insert --$\tilde{x}$(n)*--;

Column 7, equation 12, delete "Xw(n) = DS(z)H(z)W(z)" insert --Xw(z) = D(z)H(z)W(z)--.

Column 14, line 14, delete "7";

Column 14, line 23, delete "? 3";

Column 14, line 65, before "supplies" insert --and--.

Column 15, line 6, delete "x'(n)" insert --$\tilde{x}$'(n)--;

UNITED STATES PATENT AND TRADEMARK OFFICE
CERTIFICATE OF CORRECTION

PATENT NO. : 4,716,592

DATED : December 29, 1987

INVENTOR(S) : OZAWA

It is certified that error appears in the above-identified patent and that said Letters Patent is hereby corrected as shown below:

Column 15, line 10, delete "(where $1 \leq = i \leq = N_p$)" insert --(where $1 \leq i \leq N_p$)--;

Column 15, line 22, delete "$1 \leq = n \leq = N$," insert --$1 \leq n \leq N$,--;

Column 15, line 23, delete "$N+1 = \leq n \leq 2N$" insert --$N+1 \leq n \leq 2N$--;

Column 16, line 9, delete "(where $1 \leq = i \leq = N_p$)" insert --(where $1 \leq i \leq N_p$)--.

Column 17, equation 23, delete "$\phi hh = (m_i m_k) = Rhh(m_i - m_k|$" insert --$\phi hh = (m_i m_k) = Rhh(|m_i - m_k|$--;

Column 17, equation 25, In denominator delete "I".

Signed and Sealed this

Nineteenth Day of December, 1989

*Attest:*

JEFFREY M. SAMUELS

*Attesting Officer* *Acting Commissioner of Patents and Trademarks*